US006974344B2

(12) United States Patent
Comerci

(10) Patent No.: US 6,974,344 B2
(45) Date of Patent: Dec. 13, 2005

(54) BOARD MOUNTED ELECTRICAL CONNECTOR ASSEMBLY

(75) Inventor: Joseph D. Comerci, Elmhurst, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/639,049

(22) Filed: Aug. 12, 2003

(65) Prior Publication Data

US 2005/0037653 A1 Feb. 17, 2005

(51) Int. Cl.[7] ..... H01R 13/62
(52) U.S. Cl. ..... 439/329; 439/65; 439/567
(58) Field of Search ..... 439/65, 67, 328, 439/329, 378, 464, 567, 571, 581

(56) References Cited

U.S. PATENT DOCUMENTS 3,744,009 A 7/1973 Teagno et al.
3,950,060 A * 4/1976 Stipanuk et al. ..... 439/329
4,025,142 A 5/1977 Huber et al.
4,582,378 A 4/1986 Fruchard
4,668,039 A 5/1987 Marzili
4,691,977 A 9/1987 Marzili et al.
4,897,041 A 1/1990 Heiney et al.
4,938,701 A * 7/1990 Heberling ..... 439/65
5,032,088 A * 7/1991 Kuramitsu ..... 439/378
5,634,810 A * 6/1997 Niitsu et al. ..... 439/378
6,095,856 A * 8/2000 Horan et al. ..... 439/567
6,551,143 B2 4/2003 Tanakas et al.

* cited by examiner

*Primary Examiner*—Gary Paumen
*Assistant Examiner*—James R Harvey
(74) *Attorney, Agent, or Firm*—Stephen Z. Weiss

(57) ABSTRACT

An electrical connector assembly is provided for mounting on a circuit board. The assembly includes a first connector having a first dielectric housing fixed to the circuit board. A plurality of conductive terminals are mounted on the housing and are electrically connected to appropriate circuit traces on the circuit board. A second connector includes a second dielectric housing mateable with the first dielectric housing. A plurality of conductive terminals are mounted on the second housing for engaging the terminals of the first connector when the connectors are mated. At least one locking member is provided on the second dielectric housing and is lockable with the circuit board when the connectors are mated. Therefore, extraneous forces applied to the second connector are passed directly to the circuit board to protect the first connector and its connections to the board.

7 Claims, 3 Drawing Sheets

FIG. 1
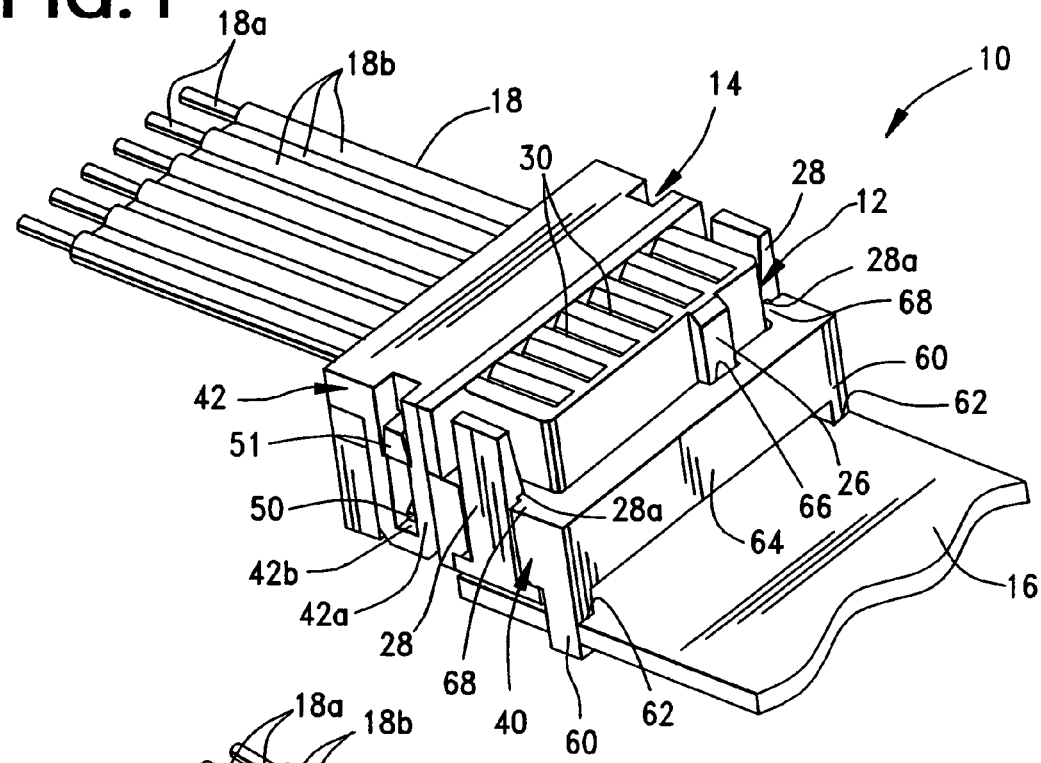
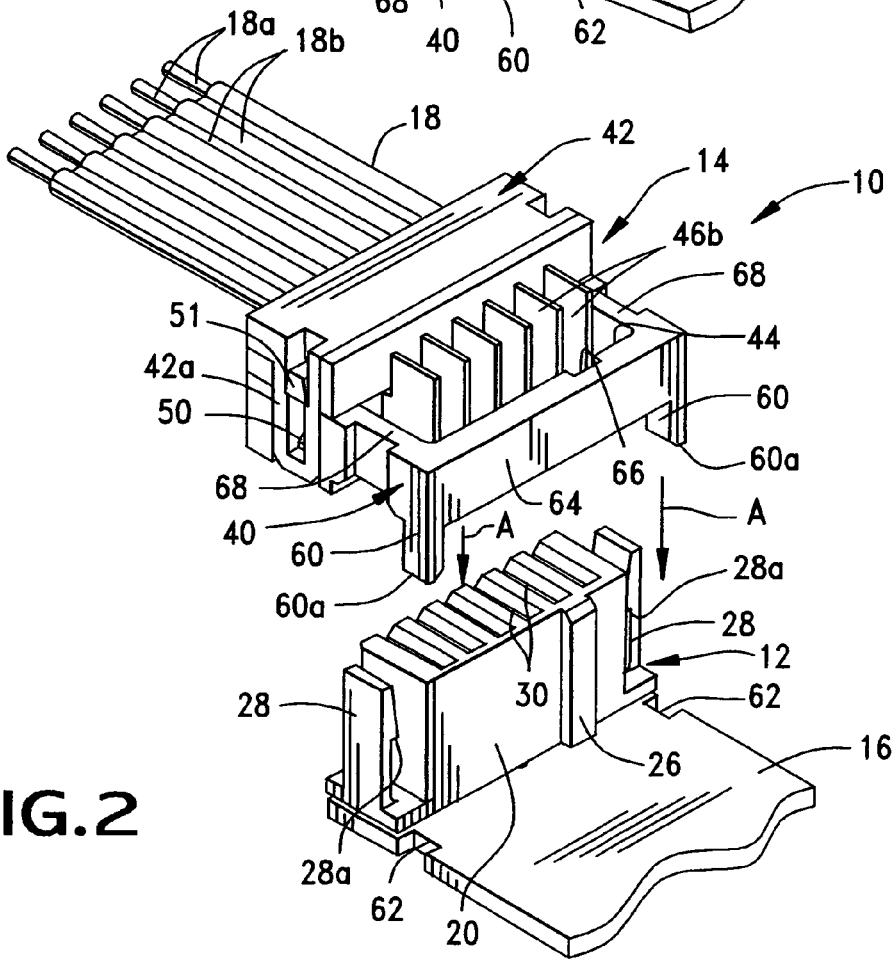
FIG. 2

FIG. 3
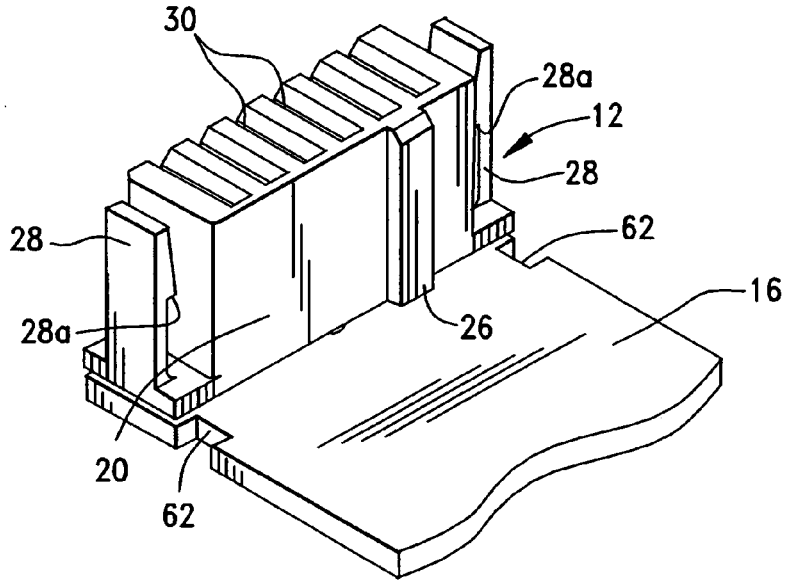
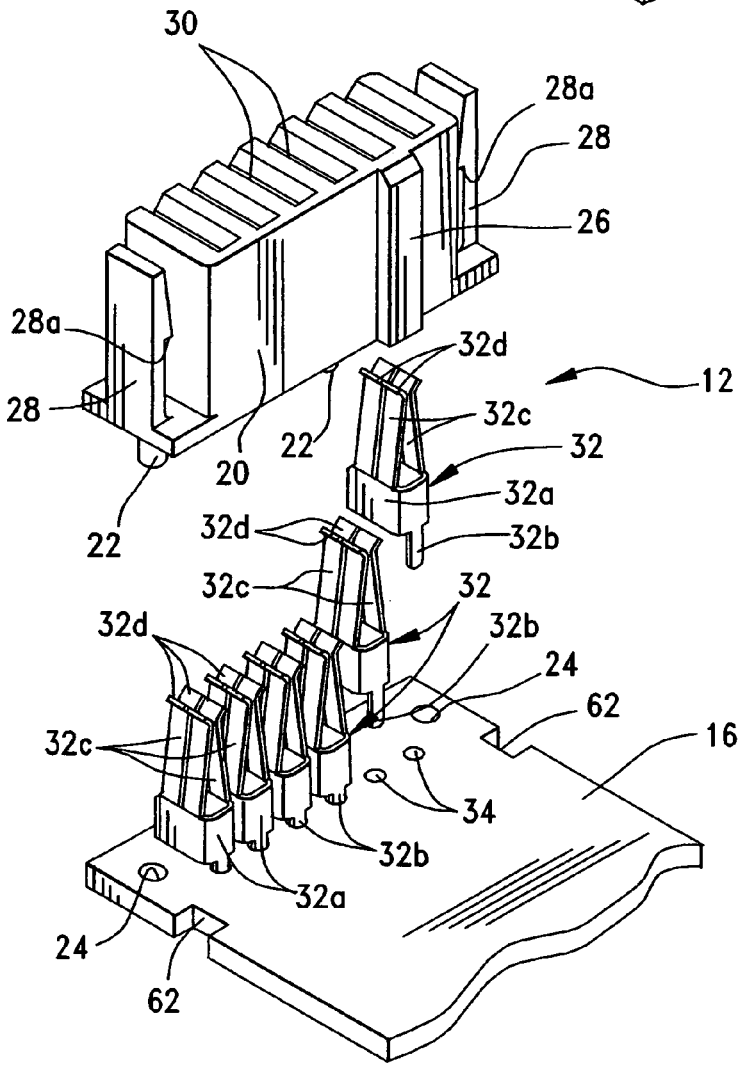
FIG. 4

BOARD MOUNTED ELECTRICAL CONNECTOR ASSEMBLY

FIELD OF THE INVENTION

This invention generally relates to the art of electrical connectors and, particularly, to an electrical connector assembly for mounting on a circuit board.

BACKGROUND OF THE INVENTION

A wide variety of electrical connector assemblies have been designed for mounting on circuit boards. A typical connector assembly includes a base or "board connector" which includes a dielectric housing which is fixed to the circuit board. A mating or "terminating connector" is terminated to a plurality of conductors, and the terminating connector mates with the board connector. The terminating connector can terminate a wide variety of conductors ranging from discrete electrical wires to flexible or ribbon cables or even a second circuit board.

Problems are encountered with board mounted connector assemblies of the character described above, when extraneous forces are applied to the conductors which are terminated to the terminating connector. For instance, if the terminating connector terminates a plurality of discrete electrical wires or a ribbon cable, pulling forces may be applied to the wires or cable. These forces can cause the terminating connector to become unmated from the board connector. Lesser forces may cause the terminals of the connectors to simply become disengaged and destroy the electrical connections through the connector assembly. Still worse, the forces may cause the board connector to become disengaged from the circuit board, itself. The present invention is directed to solving these various problems.

SUMMARY OF THE INVENTION

An object, therefore, of the invention is to provide a new and improved electrical connector assembly of the character described, for mounting on a circuit board.

In the exemplary embodiment of the invention, the assembly includes a first connector having a first dielectric housing fixed to the circuit board. A plurality of conductive terminals are mounted on the housing and are electrically connected to appropriate circuit traces on the board. A second connector includes a second dielectric housing mateable with the first dielectric housing. A plurality of conductive terminals are mounted on the second housing for engaging the terminals of the first connector when the connectors are mated. At least one locking member is provided on the second dielectric housing and is lockable with the circuit board when the connectors are mated. Therefore, extraneous forces applied to the second connector are passed directly to the circuit board to protect the first connector and its connections to the board.

According to one aspect of the invention, the locking member is integral with the second dielectric housing. In the preferred embodiment, the second dielectric housing is molded of plastic material, and the locking member is molded integrally therewith. Preferably, the locking member comprises a locking post which is insertable into a locking aperture in the circuit board.

According to another aspect of the invention, the second dielectric housing is elongated and includes a plurality of the locking posts, with at least one of the locking posts being located at each opposite end of the elongated second dielectric housing. A collar portion joins the locking posts and surrounds the first dielectric housing. A polarizing key may be provided on the collar portion to allow mating of the connectors in only one relative orientation.

According to a further aspect of the invention, the second connector is mateable with the first connector in a mating direction generally perpendicular to the circuit board. The locking post extends generally parallel to the mating direction.

Finally, another feature of the invention comprises latch means between the first and second connectors when the connectors are mated. In the preferred embodiment, the latch means include at least one flexible latch arm on one of the connectors engageable with a latch surface on the other of the connectors. The flexible latch arm extends generally parallel to the mating direction of the connectors and engages the latch surface automatically in response to mating of the connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of the electrical connector assembly embodying the concepts of the invention, mounted on a circuit board and terminating a ribbon cable;

FIG. 2 is a view similar to that of FIG. 1, with the terminating connector unmated from the board connector;

FIG. 3 is a perspective view of the board connector mounted on a circuit board;

FIG. 4 is an exploded perspective view of the board connector;

DETAILED DESCRIPTION OF THE PREFERRED EMBODIMENT

Figure 5:
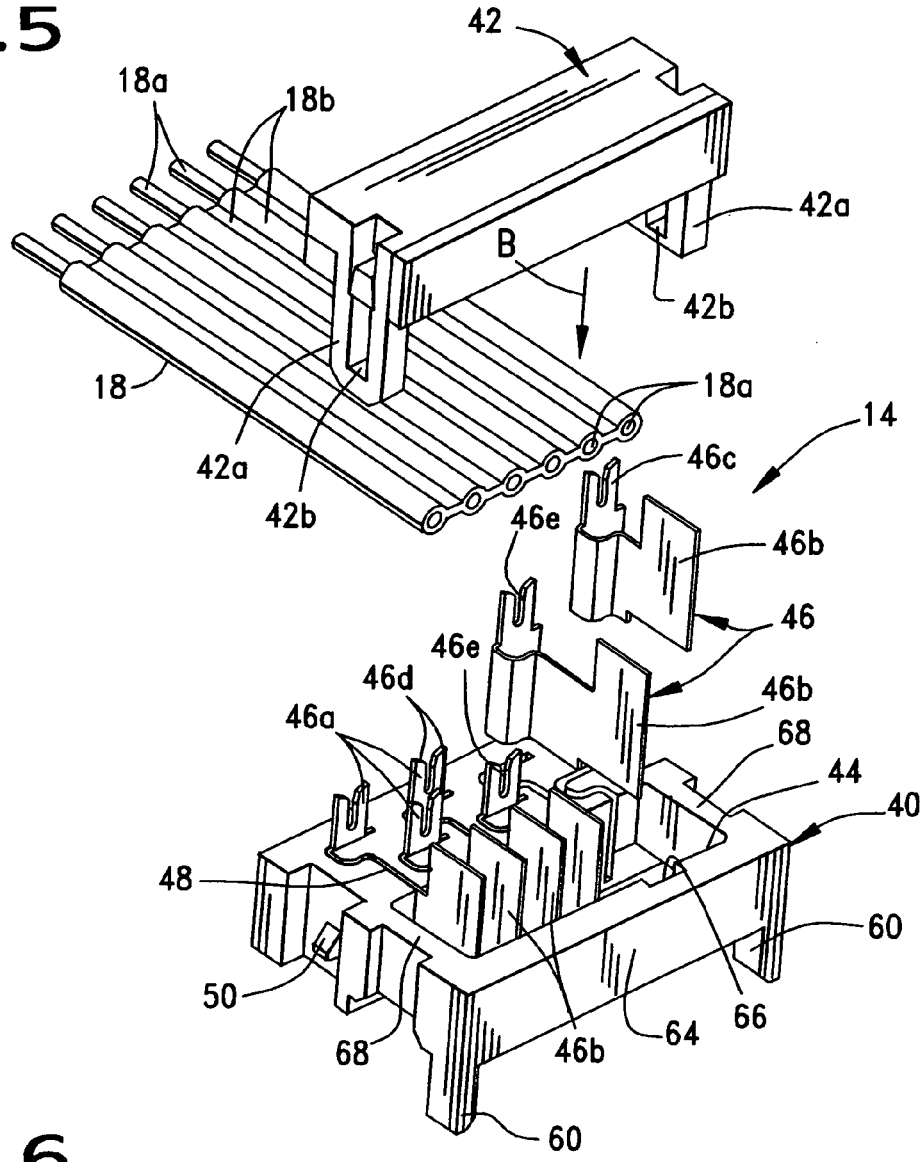
FIG. 5 is an exploded perspective view of the terminating connector.

Referring to the drawings in greater detail, and first to FIGS. 1 and 2, the invention is embodied in an electrical connector assembly, generally designated 10, which includes a first or "board connector", generally designated 12, and a second or "terminating connector", generally designated 14. Board connector 12 is designed for mounting on a flat circuit board 16. Terminating connector 14 is designed for terminating a ribbon cable 18. The ribbon cable includes a plurality of individual conductors 18*a* surrounded and joined by insulating cladding 18*b*. However, it should be understood that terminating connector 14 could terminate a wide variety of conductors other than the conductors of ribbon cable 18. For instance, the connector could terminate discrete electrical wires, a flexible cable, a flexible circuit board or a second flat circuit board, all within the concepts of the invention.

Referring to FIGS. 3 and 4 in conjunction with FIGS. 1 and 2, board connector 12 includes a molded plastic dielectric housing 20 which is fixed to circuit board 16 by means of a plurality of mounting posts 22 which are press-fit into a plurality of mounting holes 24 in the circuit board. Additional fixing means, such as an adhesive, can be used to further fix the housing and, therefore, connector 12 to circuit board 16. An elongated polarizing key 26 projects outwardly from one side of the housing, for purposes described hereinafter. A pair of flexible latch arms 28, having latch hooks 28*a*, are provided at opposite ends of housing 20, spaced outwardly therefrom. Finally, a plurality of terminal-receiving passages or slots 30 are formed in the housing and are open at the top thereof.

Referring specifically to FIG. 4, a plurality of stamped and formed metal terminals, generally designated 32, are mounted in housing 20 of board connector 12. Each terminal includes a body portion 32*a* which abuts against the top of circuit board 16 when the board connector is mounted thereon. A tail portion 32*b* projects downwardly from the body portion for insertion into a respective one of a plurality of holes 34 in circuit board 16. The tail portions are electrically connected, as by soldering, to appropriate circuit traces (not shown) on the board and/or in the holes. Finally, each terminal 32 includes pair of opposing contact arms 32*c* which are flared outwardly, as at 32*d*, at the distal ends of the arms. The outwardly flared arms define mouths therebetween which are aligned with terminal receiving passages or slots 30 in housing 20 of board connector 12.

Before proceeding with a description of terminating connector 14, reference is made back to FIG. 2 wherein it can be seen that the terminating connector is mated with board connector 12 in a mating direction indicated by arrows "A". The mating direction is generally perpendicular to circuit board 16. With that understanding, reference can be made again to FIGS. 3 and 4 where it can be seen that polarizing key 26, flexible latch arms 28 and contact arms 32*c* of terminals 32 all extend in directions generally parallel to the mating direction "A".

Referring to FIG. 5 in conjunction with FIGS. 1 and 2, terminating connector 14 has a two-part dielectric housing including a base housing part, generally designated 40, and a clamping housing part, generally designated 42. The housing parts may be individually and unitarily molded of plastic material. Base housing part 40 includes a receptacle 44 for receiving housing 20 of board connector 12 when the connectors are mated. Therefore, terminating connector 14 could be considered a receptacle connector while board connector 12 could be considered a plug connector. A plurality of stamped and formed metal terminals, generally designated 46, are mounted in base housing part 40, and clamping housing part 42 is used for driving ribbon cable 18 into termination with terminals 46, as will be described hereinafter.

Figure 6:
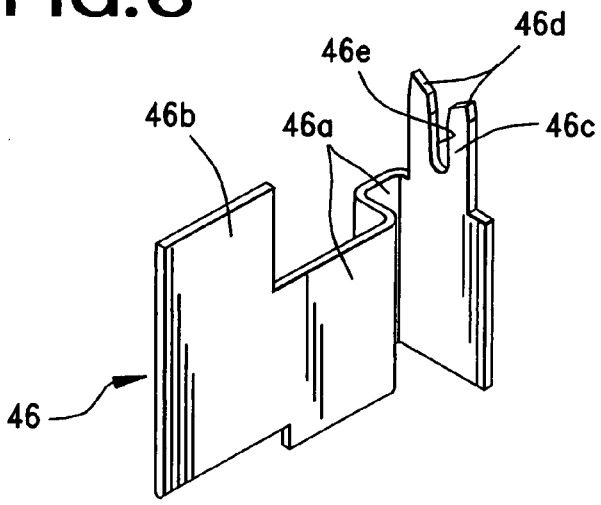
FIG. 6 is an enlarged perspective view of one of the terminals of the terminating connector.

Before proceeding with a further description of terminating connector 14, specific references is made to FIG. 6 wherein one of the terminals 46 of terminating connector 14 is shown. In particular, each terminal includes a body portion 46*a* which is inserted into a correspondingly shaped slot 48 (FIG. 5) of base housing part 40. The terminal includes a contact blade 46*b* which projects from body portion 46*a* into receptacle 44 as can be seen in FIG. 5. A bifurcated insulation-displacement portion 46*c* projects upwardly from body portion 46*a* above the top of base housing part 40, again as is seen in FIG. 5. Each insulation-displacement portion 46*c* includes pointed distal ends 46*d* on opposite sides of a slot 46*e*.

Ribbon cable 18 is terminated to terminals 46 by positioning the ribbon cable so that conductors 18*a* are in alignment with slots 46*e* of insulation-displacement portions 46*c* of terminals 46. Clamping housing part 42 is forced downwardly in the direction of arrow "B" to drive the conductors into slots 46*e* of the terminals as pointed distal ends 46*d* cut through cladding 18*b* of the ribbon cable so that the metal material of the terminals engage the conductors to establish an electrical continuity therebetween. Clamping housing part 42 has a pair of latch arms 42*a* at opposite ends thereof which define latching shoulders 42*b* for locking engagement with a pair of chamfered latch bosses 50 on base housing part 40. This holds clamping housing part 42 in engagement with ribbon cable 18 to clamp the ribbon cable in termination with terminals 46 of terminating connector 14. Latch bosses 51 define a preloaded position for clamping housing part 42.

As best seen in FIG. 2, contact blades 46*b* of terminals 46 (FIG. 5) of terminating connector 14 are spaced along receptacle 44 of base housing part 40. When terminating connector 14 is mated with board connector 12, each contact blade 46*b* is inserted between a pair of contact arms 32*c* (FIG. 4) of an appropriate one of the terminals 32 of board connector 12. Contact blades 46*b* move into the terminal-receiving passages or slots 30 in housing 20 of board connector 12, the slots being aligned with the mouths defined by outwardly flared distal ends 32*d* of contact arms 32*c* of terminals 32.

The invention contemplates the provision of locking means between terminating connector 14 and circuit board 16 when the terminating connector is mated with board connector 12. Specifically, a pair of locking posts 60 are molded integrally with base housing part 40 of terminating connector 14 and project downwardly therefrom generally parallel to mating direction "A" (FIG. 2). When the connectors are mated, the locking posts are automatically inserted into a pair of locking apertures 62 in circuit board 16. The apertures are shown as recesses at opposite edges of the board. The locking posts can be fixed within the apertures by a tight press-fit. To that end, the locking posts are chamfered, as at 60*a*. If necessary, an additional adhesive might be used.

With locking posts 60 being fixed to circuit board 16 when the connectors are mated, extraneous forces applied to terminating connector 14 are passed directly to circuit board 16 rather than to board connector 12. This protects the board connector and particularly the connections of terminals 32 to the circuit traces on the circuit board. Typical extraneous forces include pulling forces on ribbon cable 18. These pulling forces are transferred to the circuit board by means of locking posts 60 rather than to the board connector.

Base housing part 40 has a collar portion 64 which extends between locking posts 60. The collar portion defines one major side of receptacle 44 and, thereby, surrounds housing 20 of board connector 12. A keying recess 66 on the inside of the collar portion receives polarizing key 26 on housing 20 of the board connector.

Finally, complementary interengaging latch means are provided between the two connectors when the connectors are mated. Specifically, hooks 28*a* of flexible latch arms 28 of board connector 12 engage top surface areas 68 of base housing part 40 of board connector 12 as seen in FIG. 1. This latching interengagement occurs automatically when the connectors are mated because flexible latch arms 28 extend generally parallel to the mating direction "A" of the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly for mounting on a surface of a circuit board, comprising:

a first connector including a first dielectric housing fixed to the surface of the circuit board, and a plurality of conductive terminals mounted on the housing and electrically connected to appropriate circuit traces on the surface of the board;

a second connector mateable with the first connector in a mating direction generally perpendicular to the surface of the circuit board, the second connector including a second dielectric housing mateable with the first dielectric housing, a plurality of conductive terminals mounted on the second housing for engaging the terminals of the first connector when the connectors are mated, and at least one locking post on the second dielectric housing insertable into and lockable with a locking aperture in the circuit board generally parallel to said mating direction when the connectors are mated, whereby extraneous forces applied to the second connector are passed directly to the circuit board to prevent the extraneous forces from passing through the terminals of the first connector where they are electrically connected to circuit traces on the surface of the circuit board; and complementary interengaging latch means between said first and second connectors locking the connectors together when the connectors are mated.

2. The electrical connector assembly of claim 1 wherein said latch means include at least one flexible latch arm on one of the connectors engageable with a latch surface on the other of the connectors.

3. The electrical connector assembly of claim 2 wherein said flexible latch arm extends generally parallel to the mating direction and engages said latch surface automatically in response to mating of the connectors.

4. The electrical connector assembly of claim 1 wherein said second dielectric housing is, at least in part, molded of plastic material, and said locking post is molded integrally therewith.

5. The electrical connector assembly of claim 1 wherein said locking post is integral with the second dielectric housing.

6. An electrical connector assembly for mounting on a surface of a circuit board, comprising:

a first connector including a first dielectric housing fixed to the surface of the circuit board, and a plurality of conductive terminals mounted on the housing and electrically connected to appropriate circuit traces on the surface of the board;

a second connector mateable with the first connector in a mating direction generally perpendicular to the surface of the circuit board, the second connector being elongated including a second dielectric housing mateable with the first dielectric housing, a plurality of conductive terminals mounted on the second housing for engaging the terminals of the first connector when the connectors are mated, and a plurality of locking posts on the second dielectric housing insertable into a respective locking aperture in the circuit board generally parallel to said mating direction when the connectors are mated, whereby extraneous forces applied to the second connector are passed directly to the circuit board to prevent the extraneous forces from passing through the terminals of the first connector where they are electrically connected to circuit traces on the surface of the circuit board, the plurality of locking posts each being located at an opposite end of the elongated second dielectric housing and joined together by a collar portion being part of the second dielectric housing, the collar portion surrounding said first dielectric housing; and complementary interengaging latch means between said first and second connectors when the connectors are mated.

7. The electrical connector assembly of claim 6, including a polarizing key on said collar portion to allow mating of the connectors in only one relative orientation.

* * * * *